US005942934A

United States Patent [19]

Ngo et al.

[11] Patent Number: 5,942,934

[45] Date of Patent: Aug. 24, 1999

[54] ON-CHIP REGULATOR PROVIDING GOOD HIGH FREQUENCY REJECTION AND NOISE FILTERING FROM THE SUPPLY

[75] Inventors: Tuan V. Ngo, Eden Prairie; John D. Leighton, Anoka, both of Minn.

[73] Assignee: VTC Inc., Bloomington, Minn.

[21] Appl. No.: 08/890,417

[22] Filed: Jul. 9, 1997

[51] Int. Cl.[6] ..... G05F 1/10

[52] U.S. Cl. ..... 327/540; 327/538; 327/545; 323/315

[58] Field of Search ..... 327/538, 540, 327/541, 542, 543, 545, 546, 552, 558; 323/314, 315

[56] References Cited

U.S. PATENT DOCUMENTS 5,061,862 10/1991 Tamagawa ..... 327/541
5,220,206 6/1993 Tsang et al. ..... 327/546
5,335,203 8/1994 Ishii et al. ..... 327/543
5,489,873 2/1996 Kamata et al. ..... 327/558
5,689,460 11/1997 Ooishi ..... 327/538

*Primary Examiner*—Terry D. Cunningham
*Attorney, Agent, or Firm*—Kinney & Lange, P.A.

[57] ABSTRACT

A power supply filter has a primary current source coupled to a node carrying a power supply signal. The second end of the primary current source is coupled to an impedance that is further coupled to a low voltage node. A differential amplifier having an inverting input, a non-inverting input, and an output, has its non-inverting input coupled to the junction between the impedance and the primary current source. The output of the differential amplifier carries the filtered power supply signal and is coupled to a capacitance. The capacitance is coupled between the output and a lower voltage. A feedback path is coupled between the output and the inverting input.

20 Claims, 3 Drawing Sheets

ON-CHIP REGULATOR PROVIDING GOOD HIGH FREQUENCY REJECTION AND NOISE FILTERING FROM THE SUPPLY

BACKGROUND OF THE INVENTION

The present invention relates to electrical filters and in particular to power supply filters.

Most modern electrical circuits are powered by Direct Current (DC) power supplies that ideally produce a constant voltage and as much current as a circuit requires. Typically, a DC power supply's voltage and current are either taken directly from the terminals of a battery or from a rectifier that has rectified an alternating current (AC) power signal. Although these power sources should ideally provide noise-free voltages and currents, their outputs often include noise frequencies. This noise is undesirable because it can appear in the output signal of the circuit powered by the power supply.

To eliminate these unwanted noise frequencies, additional filters have been used that screen out frequencies above zero hertz. These filters appear between the DC power source and the remainder of the circuit. Ideally, such filters should not change the DC voltage or the DC current provided to the circuit. However, in practice, most filters introduce a voltage drop between the power source and the circuit or limit the amount of current available to the circuit.

For instance, many prior art filters include an output stage that has a transistor configured as an emitter-follower. This transistor provides the current needed to drive the attached circuit. Unfortunately, emitterfollowers have an inherent voltage drop from their bases to their emitters and this voltage drop lowers the voltage provided to the circuit. Although removing the emitter-follower would eliminate this voltage drop, the resulting filter would not provide enough current to power the circuit.

In light of the state of the prior art, an efficient power supply filter is needed that provides sufficient current while eliminating the voltage drop found in an emitter-follower output stage.

SUMMARY OF THE INVENTION

A power supply filter removes frequencies from a power supply signal to provide a filtered power supply. The power supply filter includes a primary current source connected between a node carrying the power supply signal and the first end of an impedance. The second end of the impedance is coupled to a node carrying a voltage that is lower than the voltage of the power supply signal. A differential amplifier with a non-inverting input, an inverting input, and an output, has its non-inverting input coupled to the first end of the impedance. The output of the differential amplifier carries the filtered power supply signal and is coupled to the first end of a capacitance. The second end of the capacitance is coupled to a reference voltage. The inverting input of the differential amplifier receives a feedback signal from the output to maintain the output at a voltage.

In preferred embodiments, the differential amplifier includes a differential pair of transistors, which have their emitters coupled together. The voltage at the base of one of the transistors, the non-inverting transistor, is determined by the voltage at the non-inverting input to the differential amplifier. The voltage at the base of the other of transistor, the inverting transistor, is determined by the voltage at the inverting input. The differential amplifier includes a current mirror carrying a first current and a second current. The first current is provided to the collector of the non-inverting transistor and the second current is split between the output and the collector of the inverting transistor. In preferred embodiments, the two currents created by the current mirror are unbalanced so that the second current provides a current to the inverting transistor that equals the collector current of the non-inverting transistor while providing enough output current to drive the remaining elements of the circuit.

In still further embodiments of the present invention, a diode is placed between the output and the inverting input of the differential amplifier to increase the output voltage of the amplifier.

DETAILED DESCRIPTION OF THE PREFERRED EMBODIMENTS

Figure 1:
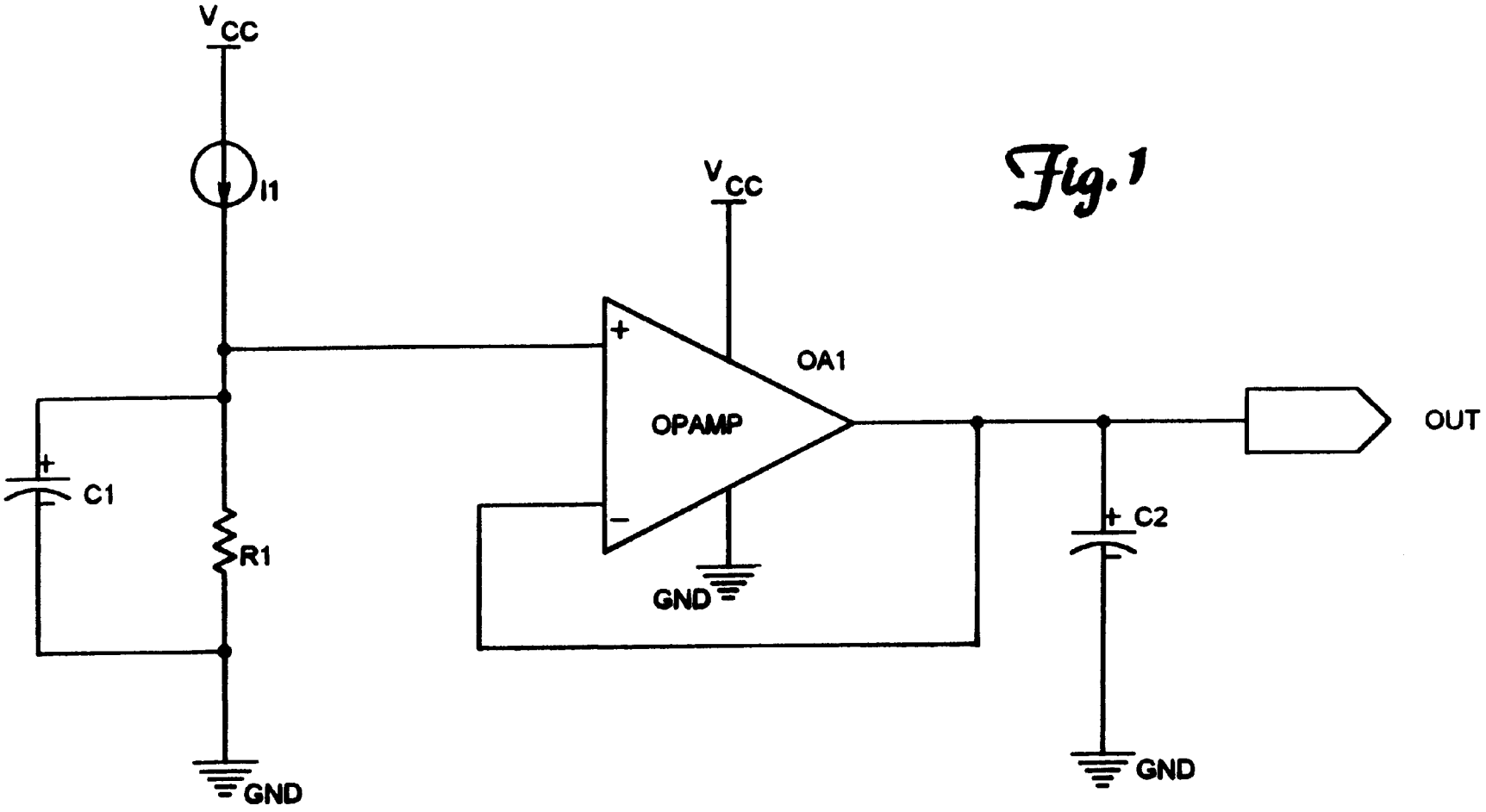
FIG. 1 is a block diagram of a power supply filter of the present invention.

FIG. 1 is a block diagram of a power supply filter of the present invention. A current source I1 is connected to a primary power supply, $V_{CC}$, provided externally to the power supply filter. Connected between current source I1 and a lower reference voltage is an impedance constructed from capacitor C1 and resistor R1 connected in parallel. The lower reference voltage is lower than the power supply voltage and is shown in FIG. 1 as ground, which is defined as 0 volts.

The node connecting current source I1, resistor R1 and capacitor C1 is further connected to a non-inverting input of an operational amplifier, Op-Amp OA1. In addition to the non-inverting input, Op-Amp OA1 has an inverting input and an output that are connected together. Op-Amp OA1 includes a voltage level shifting device at its inverting input that causes the D.C. output voltage to be approximately 0.7 volts above the voltage at the non-inverting input. Op-Amp OA1 also has power connections to primary power supply $V_{CC}$ and to ground.

The output of Op-Amp OA1 is connected to capacitor C2, which has a second terminal connected to ground. The output of Op-Amp OA1 provides a filtered power supply with sufficient current to drive other circuit elements (not shown) that are connected to the filter at output node OUT.

The filter of FIG. 1 has two modes of operation: DC and non-DC. At DC, capacitor C1 appears as an open circuit and the non-inverting input of Op-Amp OA1 appears as an extremely high impedance. Thus, nearly all of the current of current source I1 goes through resistor R1, developing a bias voltage at the non-inverting input to Op-Amp OA1.

This bias voltage causes the output voltage of Op-Amp OA1 to increase until it is approximately 0.7 volts above the voltage at the non-inverting input of Op-Amp OA1. The DC output voltage is controlled by the feedback loop from the output to the inverting input. This feedback loop maintains the output voltage at one diode drop above the voltage at the non-inverting input of Op-Amp OA1.

For frequencies above zero Hz, in other words non-DC frequencies, capacitor C1 ideally acts as a short circuit to ground. Thus, at non-DC frequencies, the non-inverting input is connected directly to ground and the voltage at the non-inverting input remains constant. Therefore, most non- DC signals created by the primary power supply and current source I1 are grounded or filtered by capacitor C1, and thus do not appear at the non-inverting input of Op-Amp OA1.

Capacitor C2 also acts as a short circuit at non-DC frequencies and thus provides a filtering function at the output of Op-Amp OA1. Typically, capacitor C2 is chosen to provide filtering at high frequencies to remove high frequency noise introduced by Op-Amp OA1. However, capacitor C2 is also effective at removing output noise introduced at Op-Amp OA1's inputs.

As discussed further below, the power supply filter of FIG. 1 provides current to the remaining circuit elements (not shown) through the output of Op-Amp OA1. Op-Amp OA1 has a circuit design that provides sufficient current at the output to drive the remaining circuit elements while minimizing the voltage drop from the primary power supply voltage. This minimizes the DC power loss across the filter while maintaining the current level required by the remaining circuit elements.

Figure 2:
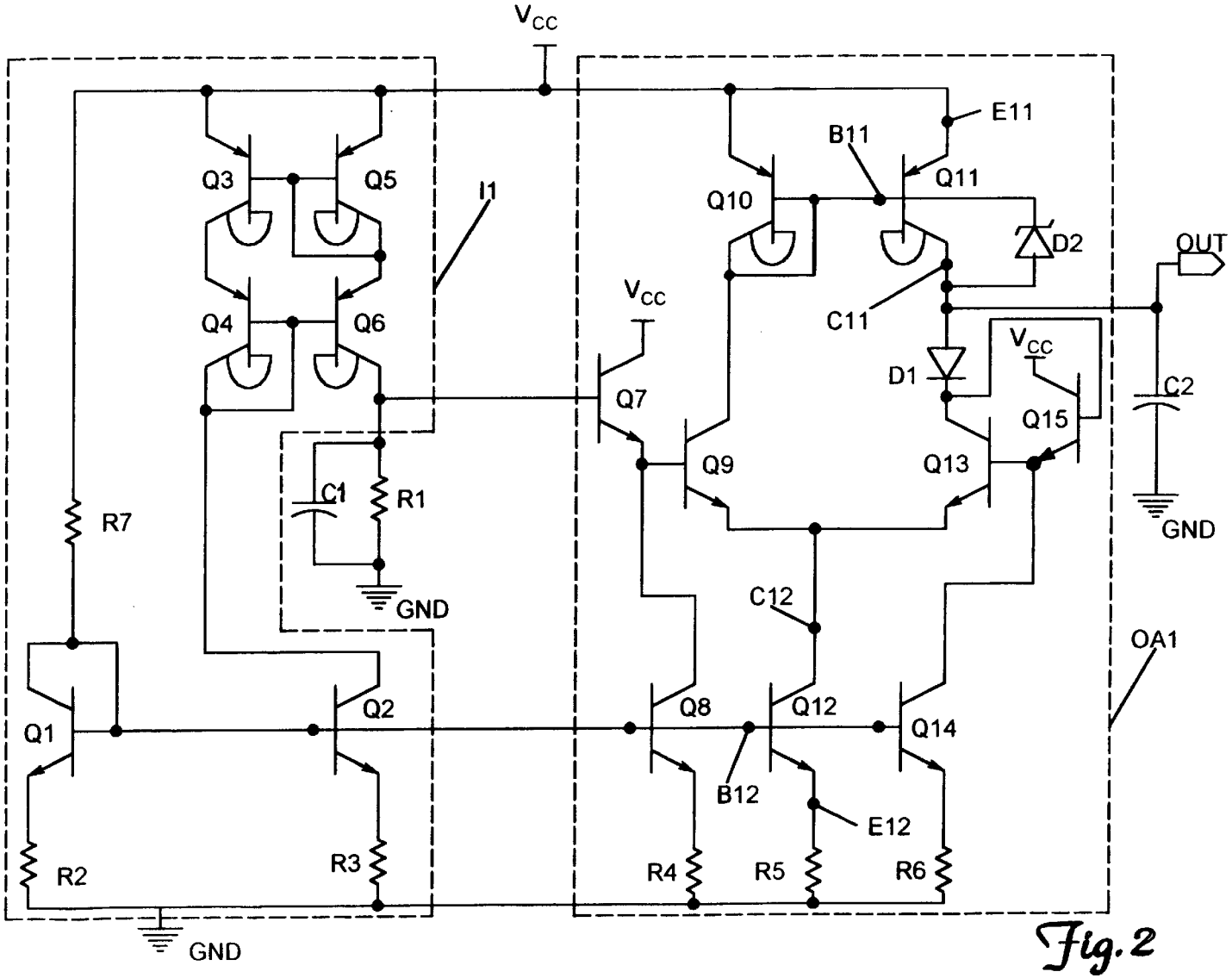
FIG. 2 is a circuit diagram of the power supply filter of FIG. 1.

FIG. 2 is a detailed circuit diagram of the power supply filter of FIG. 1. In FIG. 2, current source I1 is constructed from a series of current mirrors depicted within the boxed outline referenced by I1. Transistors Q1 and Q2 and resistors R2 and R3 form a first current mirror. Transistors Q1 and Q2 are preferably identical NPN bipolar junction transistors. The collector of transistor Q1 is connected to the base of transistor Q1, which is further connected to the base of transistor Q2. The emitter of transistor Q1 is connected to one terminal of resistor R2, which has its second terminal connected to ground. The emitter of transistor Q2 is connected to one terminal of resistor R3, which has its second terminal connected to ground. Resistors R2 and R3 are preferably identical and in preferred embodiments are each 5 KΩ. An ideal current source connected to the collector and base of transistor Q1 causes a current of 0.1 milliamps to flow through the collector of transistor Q1. Because transistors Q1 and Q2 and resistors R2 and R3 are matched, respectively, transistor Q1's collector current is mirrored into the collector of transistor Q2, causing 0.1 milliamps to flow through transistor Q2's collector.

In FIG. 2, the ideal current source is shown as resistor R7, which is connected between primary power supply $V_{CC}$ and the collector of transistor Q1. However, many other embodiments of the ideal current source are possible.

Transistor Q2's collector is further connected to the collector and base of PNP transistor Q4. Transistor Q4 forms a second current mirror with PNP transistor Q6, which is preferably identical to transistor Q4 and which has its collector coupled to capacitor C1 and resistor R1. The bases of transistors Q4 and Q6 are connected together and the emitters of transistors Q4 and Q6 are connected to an additional current mirror which acts as a matched impedance for transistors Q4 and Q6. Specifically, the emitter of transistor Q4 is connected to the collector of PNP transistor Q3 and the emitter of transistor Q6 is connected to the collector and base of PNP transistor Q5. Transistors Q5 and Q3 are preferably identical to each other and have their bases connected together and their emitters connected together at primary power supply $V_{CC}$.

Since transistors Q3 and Q5 are preferably identical to one another, their collector currents match each other. This means that transistors Q3 and Q5 provide matched resistances to the emitters of transistors Q4 and Q6 and thereby allow transistors Q4 and Q6 to operate as a unity current mirror. Thus, the collector current of transistor Q6 matches the collector current of transistor Q4. Since the collector current of transistor Q4 is drawn through the collector of transistor Q2, the collector current of transistors Q4 and Q6 are approximately equal to the collector current of transistor Q2, which is equal to the collector current of transistor Q1. Thus, the collector current of transistor Q6 is equal to the collector current of transistor Q1, which in preferred embodiments is 0.1 milliamps.

As noted above, the collector of transistor Q6 is connected to capacitor C1, resistor R1 and the non-inverting input of Op-Amp OA1. Op-Amp OA1 of FIG. 1 is shown in detail in FIG. 2 with the components of the Op-Amp shown within the dotted box referenced by OA1.

Op-Amp OA1 is constructed from a differential amplifier with a differential pair of transistors that are each buffered by emitter-follower input stages. Specifically, transistors Q9 and Q13 are NPN bipolar junction transistors that form a differential pair. Transistors Q9 and Q13 have their emitters connected together at a differential current source constructed from NPN transistor 012 and resistor R5. In particular, transistor Q12's collector, C12 is connected to the emitters of transistors Q9 and Q13, and transistor Q12's emitter, E12, is connected to resistor R5, which has a second terminal connected to ground. Transistor Q12's base, B12, is connected to the base of transistor Q1 and thus forms a current mirror with transistor Q1.

Figure 3:
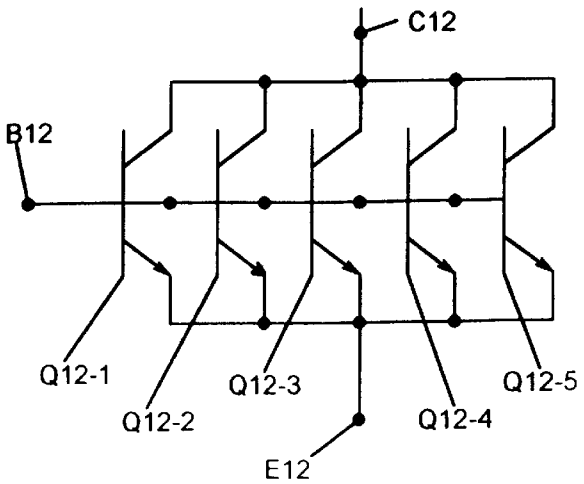
FIG. 3 is an embodiment of transistor Q12 of FIG. 2.

In preferred embodiments, transistor Q12 provides 5 times the collector current of transistor Q1 at any given instant and resistor R5 has one-fifth the resistance of resistor R2. In preferred embodiments, transistor Q12 is realized using 5 transistors in parallel, each individual transistor equivalent to transistor Q1. Such an embodiment of transistor Q12 is shown in FIG. 3 where transistors Q12-1, Q12-2, Q12-3, Q12-4, and Q12-5 are each NPN transistors equivalent to transistor Q1 of FIG. 2. The collectors of transistors Q12-1, Q12-2, Q12-3, Q12-4, and Q12-5 are connected together to form collector node C12 of FIG. 2; the five transistors' emitters are connected together to form emitter node E12 of FIG. 2; and the five transistor' bases are connected together to form base node B12 of FIG. 2. These five transistors each produce identical collector currents that individually mirror the collector current of transistor Q1. Thus, together, the five transistors produce five times the collector current of transistor Q1. For simplicity, the five transistors are shown as one transistor in FIG. 2. However, those skilled in the art will recognize that the embodiment of FIG. 3 may be substituted for Q12 in FIG. 2.

The current provided by transistor Q12 and resistor R5 is divided between transistors Q9 and Q13. When the base voltages of transistors Q9 and Q13 are equal, the current divides equally between the two transistors. However, when the base voltage of one of the transistors becomes higher than the base voltage of the other transistor, nearly all of the current flows through the transistor with the higher base voltage.

The base voltages of transistors Q9 and Q13 are determined by two respective emitter-follower input stages. NPN bipolar junction transistor Q7 forms the input emitter-follower stage at the base of transistor Q9. The collector of transistor Q7 is connected to the primary power supply $V_{CC}$ and the emitter of transistor Q7 is connected to the base of transistor Q9. The base of transistor Q7 forms the non-inverting input of Op-Amp OA1 and is connected to capacitor C1, resistor R1 and current source I1.

The emitter of transistor Q7 is further connected to a bias current source created by transistor Q8 and resistor R4. In particular, the emitter of transistor Q7 is connected to the collector of transistor Q8, the emitter of transistor Q8 is connected to resistor R4 and the second end of resistor R4 is connected to ground. The base of transistor Q8 is connected to the base of transistor Q1 forming a current mirror that reflects the collector current of transistor Q1 into the collector current of transistor Q8. In preferred embodiments, transistor Q8 is identical to transistor Q1, and resistor R4 is identical to resistor R2. Therefore, the collector current of transistor Q8 preferably matches the collector current of transistor Q1.

Similarly, NPN bipolar junction transistor Q15 forms the emitter-follower input stage for the base of transistor Q13. Transistor Q15's collector is connected to primary power supply $V_{CC}$, its emitter is connected to the base of transistor Q13, and its base forms the inverting input to Op-Amp OA1.

The emitter of transistor Q15 is further connected to a bias current source formed by transistor Q14 and resistor R6. Transistor Q14's collector is connected to the emitter of transistor Q15, and its emitter is connected to resistor R6, which is further connected to ground. The base of transistor Q14 is connected to the base of transistor Q1 forming a current mirror in which the collector current of transistor Q1 is mirrored into the collector current of transistor Q14. In preferred embodiments, transistor Q14 is equivalent to transistor Q1, and resistor R6 is equivalent to resistor R2, such that the collector current of transistor Q14 is identical to the collector current of transistor Q1.

Since transistors Q7 and Q15 carry identical currents they introduce identical voltage drops from the inverting and non-inverting inputs of the Op-Amp to the bases of transistors Q9 and Q13, respectively. Therefore the voltage difference between the inverting and non-inverting inputs directly controls the flow of current through the differential pair of transistors Q9 and Q13. Thus, if the voltage at the non-inverting input is larger than the voltage at the inverting input, nearly all of the current of transistor Q12 will flow through transistor Q9 and very little current will flow through transistor Q13. In the alternative, if the voltage at the inverting input, the base of transistor Q15, is greater than the voltage at the non-inverting input, the base of transistor Q7, nearly all of the current of transistor Q12 will flow through transistor Q13.

The base of transistor Q15 is connected to the collector of transistor Q13 and is further connected to the cathode of diode D1. The anode of diode D1 is connected to the output of Op-Amp OA1, and thus is connected to one terminal of capacitor C2, which has its second terminal connected to ground. Diode D1 produces the voltage level shifting that increases the output voltage above the voltage at the inputs of Op-Amp OA1.

The output of Op-Amp OA1 is also connected to a current mirror formed by PNP transistors Q10 and Q11 within Op-Amp OA1. Specifically, the output is connected to the collector of transistor Q11, which has its base, B11, connected to transistor Q10's base and its emitter, E11, connected to transistor Q10's emitter. The collector of transistor Q10 is connected to the collector of transistor Q9, and to the bases of transistors Q10 and Q11. A bias diode, D2, which is preferably a zener diode, is connected between the base and collector of transistor Q11 and is included in the circuit to help prevent transistor Q11 from saturating.

Figure 4:
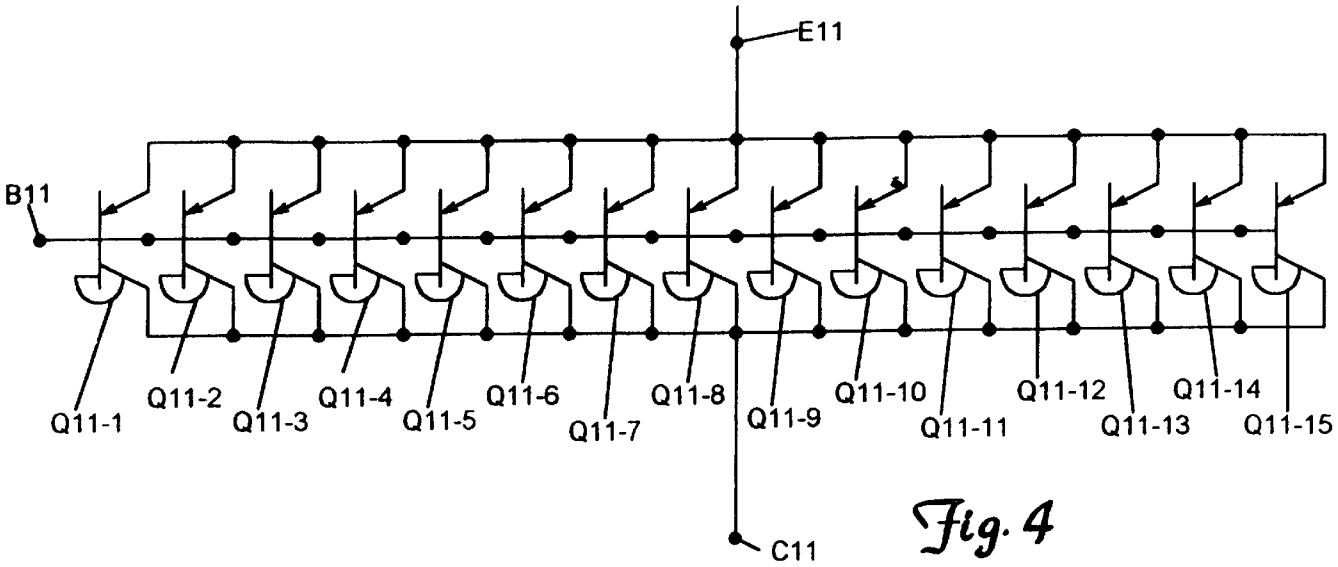
FIG. 4 is an embodiment of transistor Q11 of FIG. 2.

The current mirror created by transistors Q10 and Q11 preferably has a gain of 15 such that the collector current of transistor Q11 is 15 times the collector current of transistor Q10. In preferred embodiments, this is accomplished using 15 identical transistors connected in parallel in place of transistor Q11. Such an embodiment for transistor Q11 is shown in FIG. 4, where fifteen transistors, sequentially numbered Q11-1 through Q11-15, are shown in parallel. Each of the fifteen transistors has its respective emitter connected to emitter node E11. In addition, each of the fifteen transistors has its respective base connected to base node B11 and its respective collector connected to collector node C11. Each individual transistor of the fifteen transistors is preferably identical to transistor Q10. In FIG. 2, Q11 is shown as a single transistor for simplicity, but it is clear to those skilled in the art that the embodiment of FIG. 4 may be substitute for transistor Q11 by connecting nodes C11, E11, and B11 of FIG. 4 to the similarly identified nodes in FIG. 2. In the preferred embodiment, the bipolar devices ($Q_3$–$Q_6$, $Q_{10}$ and $Q_{11}$) are PNP bipolar junction transistors with a TUB.

In preferred embodiments, when the differential amplifier is balanced, 0.25 milliamps of current flow through the collectors of transistor Q9 and Q13, respectively. Since transistor Q10's collector is coupled to the collector of transistor Q9, approximately 0.25 milliamps flows through the collector of transistor Q10. Through the gain of the current mirror created between transistor Q10 and Q11, 3.75 milliamps (15*0.25 milliamps) flow through the collector of transistor Q11. Since the collector of transistor Q13 sinks only 0.25 milliamps, the remaining 3.5 milliamps are provided to the remainder of the electrical circuit as a power supply current.

In preferred embodiments, resistor R1 has a value of 32 kiliohms. As described above, current source I1 preferably produces 0.1 milliamps, which in combination with resistor R1 creates a DC voltage of 3.2 volts at the non-inverting input of Op-Amp OA1. When Op-Amp OA1 is balanced, this voltage must also appear at the inverting input of Op-Amp OA1. Thus, at the cathode of diode D1, the D.C. voltage is 3.2 volts. Since diode D1 introduces a 0.7 volt drop from the output to the inverting input, the output is at 3.9 volts. Thus, at DC, the preferred embodiment provides a power supply of 3.9 volts and 3.5 milliamps.

In preferred embodiments, capacitor C1 is a 10 picoferrad capacitor and capacitor C2 is a 20 picoferrad capacitor. Capacitor C1 operates to filter noise appearing at the non-inverting input of Op-Amp OA1. Capacitor C2, in combination with the output impedance of Op-Amp OA1, operates to filter noise introduced through Op-Amp OA1. This noise is believed to be introduced into the output of Op-Amp OA1 through the parasitic capacitance of transistor Q11.

Although the present invention has been described with reference to preferred embodiments, workers skilled in the art will recognize that changes may be made in form and detail without departing from the spirit and scope of the invention.

What is claimed is:

1. A power supply filter for removing frequencies from a power supply signal to provide a filtered power supply to an electrical circuit, the power supply filter comprising:

a primary current source having first and second ends, the first end for coupling to a node carrying the power supply signal;

an impedance element having first and second ends, the first end of the impedance coupled to the second end of the primary current source and the second end of the impedance element for coupling to a node carrying a voltage that is lower than the voltage of the power supply signal;

a differential amplifier having an inverting input, a non-inverting input, and an output, the non-inverting input coupled to the first end of the impedance element, the output for carrying the filtered power supply and the inverting input receiving a feedback signal from the output to maintain the output at a voltage, the differential amplifier further comprising a differential pair of transistors, the differential pair of transistors comprising first and second differential transistors each comprising respective first, second, and third terminals;

the first terminals of the first and second differential transistors coupled together;

the second terminal of the first differential transistor having a voltage controlled by the voltage of the non-inverting input;

the second terminal of the second differential transistor having a voltage controlled by the voltage of the inverting input;

the third terminal of the second differential transistor having a voltage that does not exceed the output voltage and that tracks the output voltage; and a current mirror coupled to the output and the third terminal of the first differential transistor, the current mirror for carrying at least a first and second current, the first current provided to the third terminal of the first differential transistor, the second current being split between the third terminal of the second differential transistor and the output;

a capacitance, coupled between a node carrying a reference voltage and the output of the differential amplifier; and a bias current mirror coupled to the first terminals of the first and second differential transistors.

2. The power supply filter of claim 1 wherein the first current of the current mirror is a fixed ratio of the second current of the current mirror, and the first current is less than the second current.

3. The power supply filter of claim 2 wherein the first current is produced by a single driving transistor of a first type and the second current is the sum of currents produced by a plurality of reflecting transistors of the first type.

4. The power supply filter of claim 3 wherein the single driving transistor and the plurality of reflecting transistors of the current mirror are bi-polar junction transistors with their bases coupled together and coupled to a collector of the driving transistor, the plurality of reflecting transistors having respective collectors coupled to a first end of a diode, a second end of the diode coupled to the bases of the plurality of reflecting transistors.

5. The power supply filter of claim 1 including at least one diode connected between the inverting input and the output.

6. The power supply filter of claim 1 wherein the primary current source is formed by a primary current mirror.

7. A power supply filter for removing frequencies from a power supply signal to provide a filtered power supply to an electrical circuit, the power supply filter comprising:

a primary current source having first and second ends, the first end for coupling to a node carrying the power supply signal;

an impedance element having first and second ends, the first end of the impedance coupled to the second end of the primary current source and the second end of the impedance element for coupling to a node carrying a voltage that is lower than the voltage of the power supply signal;

a differential amplifier having an inverting input, a non-inverting input, and an output, the non-inverting input coupled to the first end of the impedance element, the output for carrying the filtered power supply and the inverting input receiving a feedback signal from the output to maintain the output at a voltage, the differential amplifier further comprising a differential pair of transistors, the differential pair of transistors comprising first and second differential transistors each comprising respective first, second, and third terminals;

the first terminals of the first and second differential transistors coupled together;

the second terminal of the first differential transistor having a voltage controlled by the voltage of the non-inverting input;

the second terminal of the second differential transistor having a voltage controlled by the voltage of the inverting input;

the third terminal of the second differential transistor having a voltage that does not exceed the output voltage and that tracks the output voltage, a current mirror coupled to the output and the third terminal of the first differential transistor, the current mirror for carrying at least a first and second current, wherein the first current is produced by a single driving transistor of a first type and the second current is the sum of currents produced by a plurality of reflecting transistors of the first type, the first current is a fixed ratio of the second current, and the first current is less than the second current, the first current provided to the third terminal of the first differential transistor, the second current split between at least the third terminal of the second differential transistor and the output; and a capacitance, coupled between a node carrying a reference voltage and the output of the differential amplifier.

8. The power supply filter of claim 7 wherein the single driving transistor and the plurality of reflecting transistors of the current mirror are bipolar junction transistors with their bases coupled together and coupled to a collector of the driving transistor, the plurality of reflecting transistors having respective collectors coupled to a first end of a diode, a second end of the diode coupled to the bases of the plurality of reflecting transistors.

9. The power supply filter of claim 7 including at least one diode connected between the inverting input and the output.

10. The power supply filter of claim 7 wherein the primary current source is formed by a primary current mirror.

11. A power supply filter for removing frequencies from a power supply signal to provide a filtered power supply to an electrical circuit, the power supply filter comprising:

a primary current source having first and second ends, the first end for coupling to a node carrying the power supply signal;

an impedance element having first and second ends, the first end of the impedance coupled to the second end of the primary current source and the second end of the impedance element for coupling to a node carrying a voltage that is lower than the voltage of the power supply signal;

a differential amplifier having an inverting input, a non-inverting input, and an output, the non-inverting input coupled to the first end of the impedance element, the output for carrying the filtered power supply and the inverting input receiving a feedback signal from the output to maintain the output at a voltage, the differential amplifier further comprising a differential pair of transistors, the differential pair of transistors comprising first and second differential transistors each comprising respective first, second, and third terminals;

the first terminals of the first and second differential transistors coupled together;

the second terminal of the first differential transistor having a voltage controlled by the voltage of the non-inverting input;

the second terminal of the second differential transistor having a voltage controlled by the voltage of the inverting input;

the third terminal of the second differential transistor having a voltage that does not exceed the output voltage and that tracks the output voltage;

a capacitance, coupled between a node carrying a reference voltage and the output of the differential amplifier; and at least one diode connected between the inverting input and the output.

12. The power supply filter of claim 11 wherein the differential amplifier further comprises a current mirror coupled to the output and the third terminal of the first differential transistor, the current mirror for carrying at least a first and second current, the first current provided to the third terminal of the first differential transistor, the second current split between at least the third terminal of the second differential transistor and the output.

13. The power supply filter of claim 12 wherein the first current of the current mirror is a fixed ratio of the second current of the current mirror, and the first current is less than the second current.

14. The power supply filter of claim 13 wherein the first current is produced by a single driving bipolar junction transistor and the second current is produced by a plurality of bipolar junction reflecting transistors, the bases of the plurality of bipolar junction reflecting transistors being coupled together and to a collector of the bipolar driving transistor, the plurality of reflecting transistors having respective collectors coupled to a first end of a diode, and a second end of the diode coupled to the bases of the plurality of reflecting transistors.

15. A power supply filter for removing frequencies from a power supply signal to provide a filtered power supply to an electrical circuit, the power supply filter comprising:

a primary current source having first and second ends, the first end for coupling to a node carrying the power supply signal;

an impedance element having first and second ends, the first end of the impedance coupled to the second end of the primary current source and the second end of the impedance element for coupling to a node carrying a voltage that is lower than the voltage of the power supply signal;

a differential amplifier having an inverting input, a non-inverting input, and an output, the non-inverting input coupled to the first end of the impedance element, the output for carrying the filtered power supply and the inverting input receiving a feedback signal from the output to maintain the output at a voltage, the differential amplifier further comprising a differential pair of bipolar transistors, the differential pair of bipolar transistors comprising first and second differential bipolar transistors each comprising respective first, second, and third terminals;

the first terminals of the first and second differential bipolar transistors coupled together;

the second terminal of the first differential bipolar transistor having a voltage controlled by the voltage of the non-inverting input;

the second terminal of the second differential bipolar transistor having a voltage controlled by the voltage of the inverting input;

the third terminal of the second differential bipolar transistor having a voltage that does not exceed the output voltage and that tracks the output voltage; and a current mirror coupled to the output and the third terminal of the first differential bipolar transistor, the current mirror carrying at least a first and second current, the first current provided to the third terminal of the first differential bipolar transistor, the second current being split between the third terminal of the second differential bipolar transistor and the output;

a capacitance, coupled between a node carrying a reference voltage and the output of the differential amplifier; and a bias current mirror coupled to the first terminals of the first and second differential bipolar transistors to mirror bias current to the first and second differential bipolar transistors.

16. The power supply filter of claim 15 wherein the first current of the current mirror is a fixed ratio of the second current of the current mirror, and the first current is less than the second current.

17. The power supply filter of claim 16 wherein the first current is produced by a single driving bipolar transistor of a first type and the second current is the sum of currents produced by a plurality of reflecting bipolar transistors of the first type.

18. The power supply filter of claim 17 wherein the bases of the plurality of reflecting transistors are coupled together and coupled to a collector of the driving bipolar transistor, the plurality of reflecting bipolar transistors having respective collectors coupled to a first end of a diode, a second end of the diode coupled to the bases of the plurality of reflecting bipolar transistors.

19. The power supply filter of claim 18 including at least one diode connected between the inverting input and the output.

20. The power supply filter of claim 15 wherein the primary current source is formed by a primary current mirror.

* * * * *